US008851302B2

(12) United States Patent
Burton et al.

(10) Patent No.: US 8,851,302 B2
(45) Date of Patent: Oct. 7, 2014

(54) PRODUCT DISPENSING SYSTEM WITH CONTAINER-PRODUCT INTERACTION

(75) Inventors: Steven W. Burton, Richmond, VA (US); Bipin Raman Patil, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

(21) Appl. No.: 13/447,371

(22) Filed: Apr. 16, 2012

(65) Prior Publication Data

US 2013/0270203 A1 Oct. 17, 2013

(51) Int. Cl.

| | |
|---|---|
| ***A47F 1/04*** | (2006.01) |
| ***A47F 1/08*** | (2006.01) |
| *A47F 1/12* | (2006.01) |

(52) U.S. Cl.

CPC .. *A47F 1/087* (2013.01); *A47F 1/12* (2013.01)
USPC ..... 211/59.2; 221/195

(58) Field of Classification Search

CPC ..... G07F 11/045; G07F 11/02; G07F 11/04; A47F 1/087; A47F 1/12; B65D 5/5206; B65D 5/725; B65D 71/36; B65D 2571/00617; B65D 2571/0066; B65D 2571/00728; B65D 2571/00141; Y10S 83/946
USPC ..... 211/59.2; 220/530, 529; 229/120.15, 229/120.14, 120.18, 120.08, 120.02; 221/195, 202, 109, 281, 285, 287
See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Cough |
| 1,383,318 | A | 7/1921 | McCormick |
| 1,393,964 | A | 10/1921 | Potts et al. |
| 1,753,957 | A | 4/1930 | Washburn |
| 1,824,937 | A | 9/1931 | Trouth |
| 1,898,056 | A | 2/1933 | Johnson |
| 1,919,907 | A | 7/1933 | Robinson |
| 1,932,225 | A | 10/1933 | Minter |
| 1,941,458 | A | 2/1934 | Bens |

(Continued)

FOREIGN PATENT DOCUMENTS

| | | |
|---|---|---|
| DE | 2655496 | 6/1978 |
| DE | 29808673 | 11/1998 |

(Continued)

OTHER PUBLICATIONS

International Search Report and Written Opinion, PCT/US2013/035947 (2013).

*Primary Examiner* — Korie H Chan
(74) *Attorney, Agent, or Firm* — MeadWestvaco Intellectual Property Group

(57) ABSTRACT

A product dispensing system including a dispenser having a front end longitudinally opposed from a rear end, the dispenser including a container support deck extending at least partially between the front and rear ends, and a lower support deck positioned below the container support deck, the lower support deck defining a product display area, a container positioned on the container support deck, the container defining an internal volume and including an interference member extending into the internal volume, and a number of products received in the internal volume and arranged in at least a first row and a second row, the second row being positioned above the first row, wherein the interference member is positioned to restrict longitudinal movement at least one product in the second row.

20 Claims, 9 Drawing Sheets

(56) References Cited

U.S. PATENT DOCUMENTS

| | | | | |
|---|---|---|---|---|
| 1,985,739 | A | 12/1934 | Murray | |
| 2,078,599 | A | 4/1937 | McCauley | |
| 2,110,194 | A | 3/1938 | Blier | |
| 2,263,353 | A | 11/1941 | Eidam | |
| 2,291,187 | A | 7/1942 | Johnson | |
| 2,299,027 | A * | 10/1942 | Novak | 229/122.1 |
| 2,382,191 | A | 7/1944 | Weichselbaum | |
| 2,536,421 | A | 2/1951 | Burhans | |
| 2,573,381 | A | 10/1951 | Arnold | |
| 2,574,087 | A | 11/1951 | Burhans | |
| 2,595,122 | A | 4/1952 | Burhans | |
| 2,784,871 | A | 3/1957 | Gabrielsen | |
| 2,795,845 | A | 6/1957 | Shimer | |
| 2,818,978 | A | 1/1958 | Post | |
| 2,826,471 | A | 3/1958 | Fonda | |
| 2,831,591 | A | 4/1958 | Morton | |
| 2,888,145 | A | 5/1959 | Knott et al. | |
| 2,915,932 | A | 12/1959 | Gross | |
| 2,919,488 | A | 1/1960 | Brownlee | |
| 2,996,344 | A | 8/1961 | Garman | |
| 3,018,149 | A | 1/1962 | Parker | |
| 3,055,293 | A | 9/1962 | Lariccia | |
| 3,066,827 | A | 12/1962 | Pryor | |
| 3,137,068 | A | 6/1964 | Quigley | |
| D198,888 | S | 8/1964 | Heselov | |
| 3,178,242 | A | 4/1965 | Ellis et al. | |
| 3,184,104 | A | 5/1965 | De Domenico et al. | |
| 3,203,554 | A | 8/1965 | Pendergrast et al. | |
| 3,204,335 | A | 9/1965 | Hughes | |
| 3,288,544 | A | 11/1966 | Knecht | |
| 3,300,115 | A | 1/1967 | Schauer | |
| 3,304,141 | A | 2/1967 | Rogers | |
| 3,318,455 | A | 5/1967 | Takahashi | |
| 3,335,940 | A | 8/1967 | Dykes | |
| 3,340,790 | A | 9/1967 | Simjian | |
| 3,348,738 | A | 10/1967 | Hertlein | |
| 3,392,901 | A | 7/1968 | Krzyzanowski | |
| 3,393,808 | A | 7/1968 | Chirchill | |
| 3,501,016 | A | 3/1970 | Eaton | |
| 3,763,557 | A | 10/1973 | Sewell | |
| 3,784,022 | A | 1/1974 | Beesley, Jr. | |
| 3,922,778 | A | 12/1975 | Aalpoel | |
| 3,923,159 | A | 12/1975 | Taylor et al. | |
| 3,972,454 | A | 8/1976 | Croley | |
| 4,105,126 | A | 8/1978 | Deffner et al. | |
| 4,205,440 | A | 6/1980 | Morgan | |
| 4,260,072 | A | 4/1981 | Quasarano | |
| 4,318,458 | A | 3/1982 | Ritsema | |
| 4,382,526 | A | 5/1983 | Stone | |
| 4,396,143 | A | 8/1983 | Killy | |
| 4,435,026 | A | 3/1984 | Johnson | |
| 4,467,524 | A | 8/1984 | Ruff et al. | |
| 4,576,272 | A | 3/1986 | Morgan, Jr. | |
| 4,598,828 | A | 7/1986 | Young et al. | |
| 4,729,480 | A | 3/1988 | Groover et al. | |
| 4,744,489 | A | 5/1988 | Binder et al. | |
| 4,834,263 | A | 5/1989 | Becze | |
| 4,869,395 | A | 9/1989 | Rubbmark | |
| 4,911,309 | A | 3/1990 | Stefan | |
| 4,915,571 | A | 4/1990 | Toshihiko et al. | |
| 4,923,070 | A | 5/1990 | Jackle et al. | |
| 4,997,106 | A | 3/1991 | Rockola | |
| 4,998,628 | A | 3/1991 | Ross | |
| 5,033,348 | A | 7/1991 | Walsh | |
| 5,042,687 | A * | 8/1991 | McKinley | 221/311 |
| 5,080,256 | A | 1/1992 | Rockola | |
| 5,101,703 | A | 4/1992 | Tanaka et al. | |
| 5,167,345 | A | 12/1992 | Bleeker | |
| 5,190,155 | A | 3/1993 | Grunwald | |
| 5,251,972 | A | 10/1993 | Zurawin | |
| 5,289,943 | A | 3/1994 | Powell | |
| 5,314,078 | A | 5/1994 | Morikiyo et al. | |
| 5,328,258 | A | 7/1994 | Scalise | |
| 5,356,033 | A | 10/1994 | Delaney | |
| 5,372,278 | A | 12/1994 | Leight | |
| 5,390,821 | A | 2/1995 | Markel | |
| 5,396,997 | A | 3/1995 | Johnson | |
| D363,174 | S | 10/1995 | Fletcher, Sr. | |
| 5,462,198 | A | 10/1995 | Schwimmer | |
| 5,529,207 | A | 6/1996 | Oden et al. | |
| 5,638,988 | A | 6/1997 | Rogers | |
| 5,685,664 | A | 11/1997 | Parham et al. | |
| 5,740,610 | A | 4/1998 | Ayer et al. | |
| 5,775,572 | A * | 7/1998 | Oliff | 229/120.03 |
| 5,788,117 | A | 8/1998 | Zimmanck | |
| 5,791,048 | A | 8/1998 | Bodnar et al. | |
| 5,836,478 | A | 11/1998 | Weiss | |
| 5,878,862 | A | 3/1999 | Dewsnap | |
| 5,894,942 | A | 4/1999 | Miyashita et al. | |
| 5,924,573 | A | 7/1999 | Piraneo et al. | |
| 5,992,286 | A | 11/1999 | Boole | |
| 5,992,652 | A | 11/1999 | Springs | |
| 6,186,345 | B1 | 2/2001 | Robertson | |
| 6,199,720 | B1 | 3/2001 | Rudick et al. | |
| 6,206,237 | B1 | 3/2001 | Dillon et al. | |
| 6,253,930 | B1 | 7/2001 | Freidus et al. | |
| 6,267,258 | B1 | 7/2001 | Wilkerson et al. | |
| 6,393,799 | B2 | 5/2002 | Jenkins et al. | |
| 6,453,641 | B1 | 9/2002 | Puckett | |
| 6,637,604 | B1 | 10/2003 | Jay | |
| 6,802,433 | B2 | 10/2004 | Leykin | |
| 6,959,857 | B2 * | 11/2005 | Bates | 229/122.1 |
| 6,991,116 | B2 | 1/2006 | Johnson et al. | |
| 7,207,447 | B2 | 4/2007 | Medcalf et al. | |
| 7,303,095 | B2 | 12/2007 | Nagelski et al. | |
| 7,475,777 | B2 * | 1/2009 | Fung et al. | 206/427 |
| 7,546,973 | B2 | 6/2009 | Budz et al. | |
| 7,584,854 | B2 | 9/2009 | Chandaria | |
| D604,972 | S | 12/2009 | Henry et al. | |
| 7,665,618 | B2 | 2/2010 | Jay et al. | |
| 7,681,745 | B2 | 3/2010 | Richter | |
| 7,757,890 | B2 | 7/2010 | Alford et al. | |
| 7,810,672 | B1 | 10/2010 | Mason et al. | |
| 7,823,733 | B2 | 11/2010 | Futori | |
| 7,850,015 | B1 | 12/2010 | Mason | |
| 7,913,860 | B2 | 3/2011 | Merl | |
| 7,918,365 | B2 | 4/2011 | White et al. | |
| 7,922,437 | B1 | 4/2011 | Loftin et al. | |
| 7,992,747 | B2 | 8/2011 | Bauer | |
| 8,028,855 | B2 | 10/2011 | White et al. | |
| 2002/0043509 | A1 | 4/2002 | Lajeunesse et al. | |
| 2003/0173322 | A1 | 9/2003 | Rushing | |
| 2004/0011751 | A1 | 1/2004 | Johnson et al. | |
| 2004/0079760 | A1 | 4/2004 | Rink | |
| 2004/0262326 | A1 | 12/2004 | Christensen | |
| 2005/0092644 | A1 | 5/2005 | Cafferata | |
| 2005/0127015 | A1 | 6/2005 | Medcalf et al. | |
| 2005/0207877 | A1 | 9/2005 | Haverdink | |
| 2006/0081692 | A1 | 4/2006 | Stewart et al. | |
| 2006/0237384 | A1 | 10/2006 | Neumann et al. | |
| 2006/0243683 | A1 | 11/2006 | Onachilla et al. | |
| 2006/0278591 | A1 | 12/2006 | Tippets et al. | |
| 2007/0194037 | A1 | 8/2007 | Close | |
| 2008/0245813 | A1 | 10/2008 | Johnson et al. | |
| 2009/0212066 | A1 | 8/2009 | Bauer | |
| 2009/0266776 | A1 | 10/2009 | Johnson | |
| 2009/0277853 | A1 | 11/2009 | Bauer | |
| 2010/0032391 | A1 | 2/2010 | Schneider et al. | |
| 2011/0121010 | A1 | 5/2011 | Loftin et al. | |
| 2011/0121011 | A1 | 5/2011 | Gelardi et al. | |

FOREIGN PATENT DOCUMENTS

| | | | |
|---|---|---|---|
| DE | 19808162 | | 9/1999 |
| DE | 20111307 | | 10/2001 |
| DE | 202007012114 | | 11/2007 |
| GB | 2190906 | | 12/1978 |
| GB | 2303624 | | 2/1997 |
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |

(56) References Cited

FOREIGN PATENT DOCUMENTS

| | | | |
|---|---|---|---|
| JP | 03273472 | A | 12/1991 |
| JP | 03273474 | A | 12/1991 |
| JP | 03273476 | A | 12/1991 |
| JP | 03273477 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |
| JP | 10269421 | A | 10/1998 |
| JP | 11011471 | A | 1/1999 |
| JP | 11171264 | A | 6/1999 |
| JP | 11191175 | A | 7/1999 |
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO 9106076 | | 5/1991 |
| WO | WO 9321074 | | 10/1993 |
| WO | WO 9423619 | | 10/1994 |
| WO | WO 0054632 | | 9/2000 |
| WO | WO 2004014755 | | 2/2004 |
| WO | WO 2004113808 | | 12/2004 |
| WO | WO 2009138538 | | 11/2009 |
| WO | WO 2011025483 | | 3/2011 |
| WO | WO 2011109350 | | 9/2011 |

* cited by examiner

PRODUCT DISPENSING SYSTEM WITH CONTAINER-PRODUCT INTERACTION

FIELD

This application relates to the dispensing of products from packaging containers and, more particularly, to product dispensers configured to cooperate with packaging containers to dispense products.

BACKGROUND

Products are typically shipped to retailers in bulk by enclosing multiple individual product units in a container, such as a carton or box. For example, canned foods may be shipped to a retailer in a box containing twenty-four individual cans. Then, it is typically the retailer's obligation to remove the individual product units from the container and present them (e.g., on a shelf) to consumers.

Alternatives to the traditional package-ship-unpack-display model have been developed in an effort to improve operating efficiency. For example, U.S. Pat. No. 7,922,437 (issued on Apr. 12, 2011) discloses a product dispensing system that includes a dispenser having a support structure, a product display area and an opening tool. The dispenser may be positioned on a retailer's shelf and loaded with product simply by placing a container comprising multiple units of product onto the support structure of the dispenser. As the container is being placed onto the support structure, the opening tool of the dispenser opens the container in such a manner that product rolls from the container and down to the product display area of the dispenser under the force of gravity.

Unfortunately, product dispensing systems may experience product bridging that prevents products from properly exiting the container and moving through the dispenser. For example, as shown in FIG. 1, when a container 2 is positioned on a dispenser 4, a product 6A may bridge the gap between the container 2 and product 6B, thereby preventing all of the products 6 from passing through the opening 8 in the container 2 and moving into the dispenser 4.

Accordingly, those skilled in the art continue with research and development efforts directed to product dispensing systems.

SUMMARY

In one embodiment, the disclosed product dispensing system may include a dispenser having a front end longitudinally opposed from a rear end, the dispenser including a container support deck extending at least partially between the front and rear ends, and a lower support deck positioned below the container support deck, the lower support deck defining a product display area, a container positioned on the container support deck, the container defining an internal volume and including an interference member extending into the internal volume, and a plurality of products received in the internal volume and arranged in at least a first row and a second row, the second row being positioned above the first row, wherein the interference member is positioned to restrict longitudinal movement at least one product in the second row.

In another embodiment, the disclosed product dispensing system may include a dispenser having a front end longitudinally opposed from a rear end, the dispenser including a container support deck extending at least partially between the front end and the rear end, the container support deck defining a dispenser opening, and a lower support deck positioned below the container support deck, the lower support deck defining a product display area, a container positioned on the container support deck, the container defining an internal volume and an access opening into the internal volume, wherein the access opening is aligned with the dispenser opening, the container including an interference member that extends into the internal volume, and a plurality of products received in the internal volume, the products being arranged into at least a first row and a second row, the second row being positioned above the first row, wherein the interference member extends into the second row.

In yet another embodiment, also disclosed is a method for dispensing products comprising. The method may include the steps of (1) providing a dispenser including a container support deck and a lower support deck positioned below the container support deck, the lower support deck defining a product display area, (2) providing a container initially housing a plurality of products, wherein the products are arranged in at least a first row and a second row, (3) forming an access opening in the container, the access opening being size to allow the products to pass therethrough, (4) positioning the container with the access opening on the container support deck such that at least one product of the plurality of products exits the container through the access opening and moves to the product display area, and (5) while the container is positioned on the container support deck, restricting longitudinal movement toward the access opening of the products of in the second row.

Other embodiments of the disclosed product dispensing system and method with container-product interaction will become apparent from the following detailed description, the accompanying drawings and the appended claims.

DETAILED DESCRIPTION

Disclosed is a product dispensing system that may include a dispenser and a container that initially houses products intended to be dispensed by the dispenser. The container may be configured to beneficially interact with the products housed in the container such that the occurrence of product bridging within the container may be reduced or eliminated when the container is mounted on the dispenser.

Figure 1:
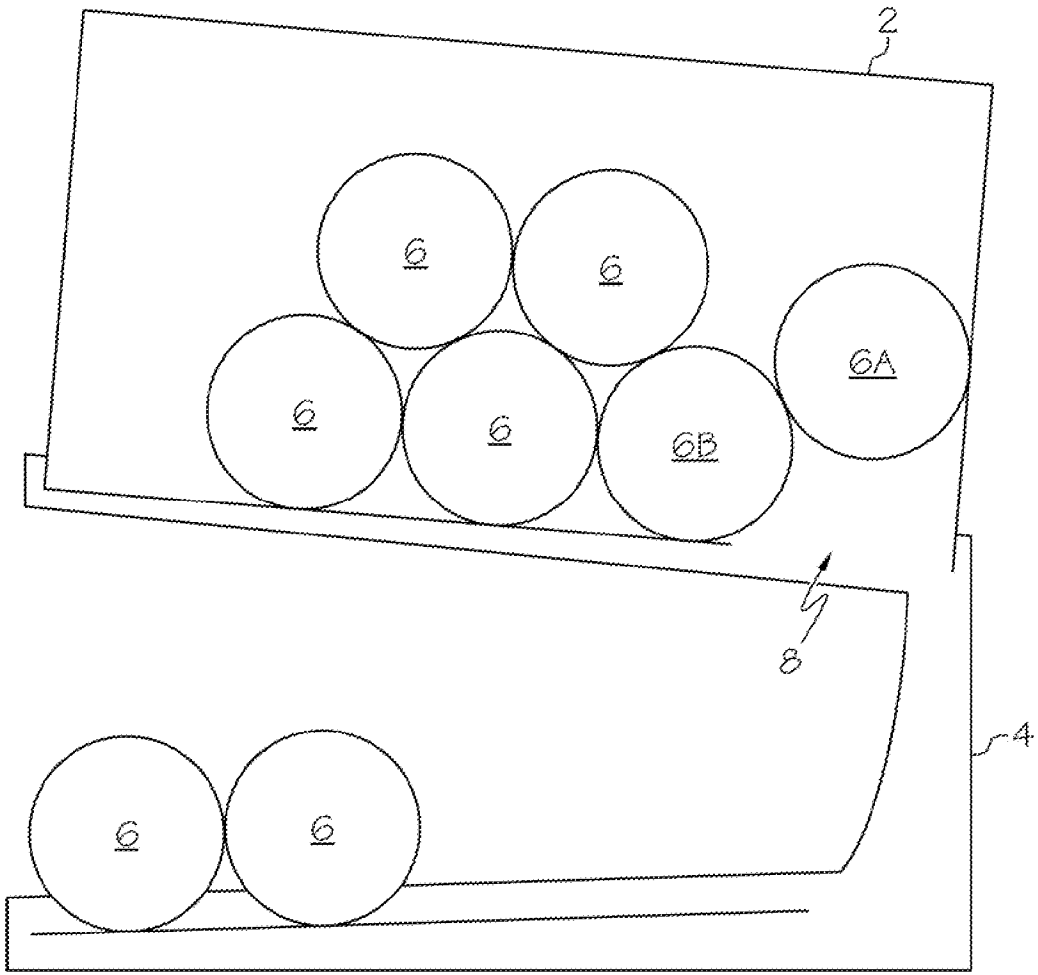
FIG. 1 (PRIOR ART)
FIG. 1 is a side elevational view of a prior art product dispensing system, shown with product bridging within the container.
Figure 2:
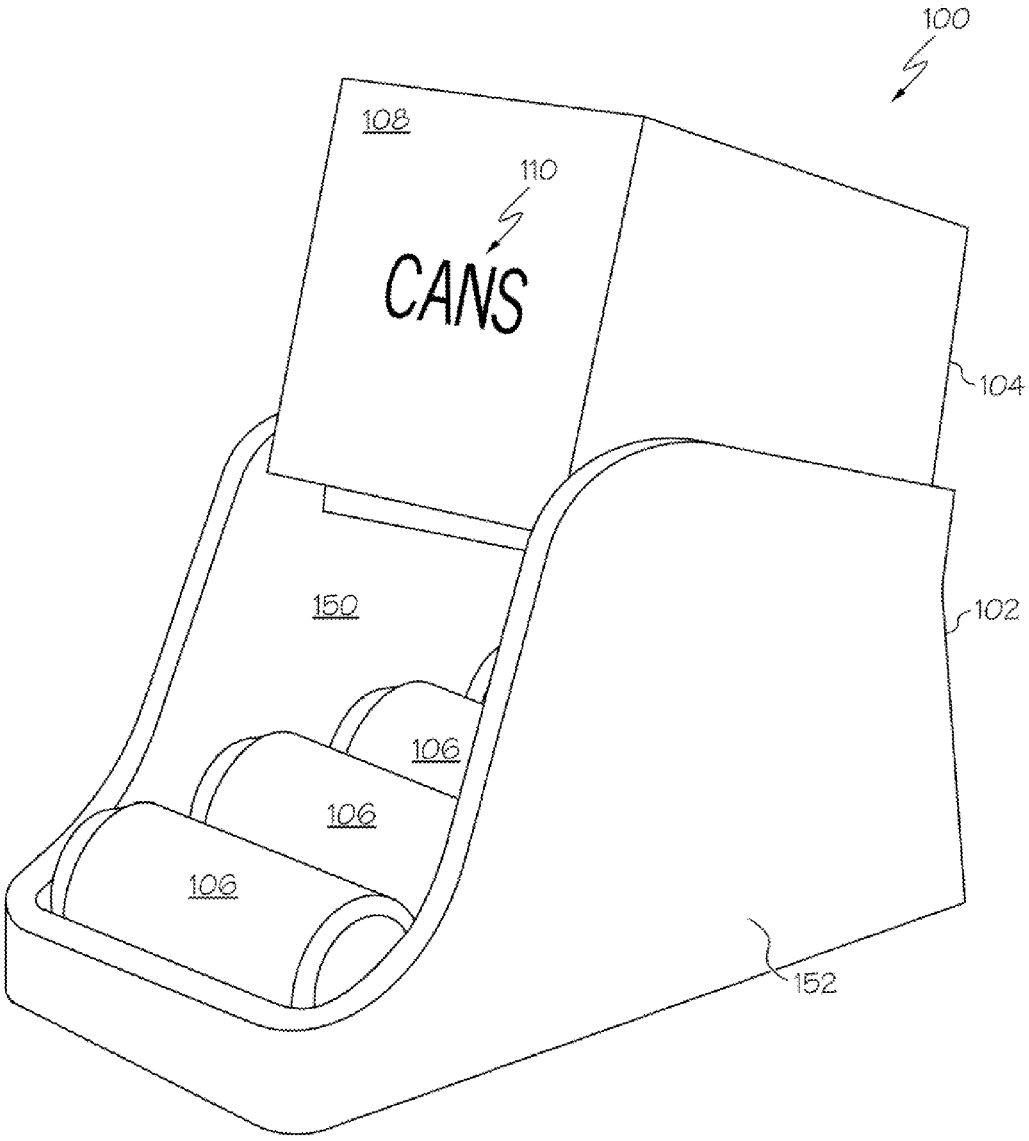
FIG. 2 is a front and side perspective view of one embodiment of the disclosed product dispensing system with container-product interaction.
Figure 3:
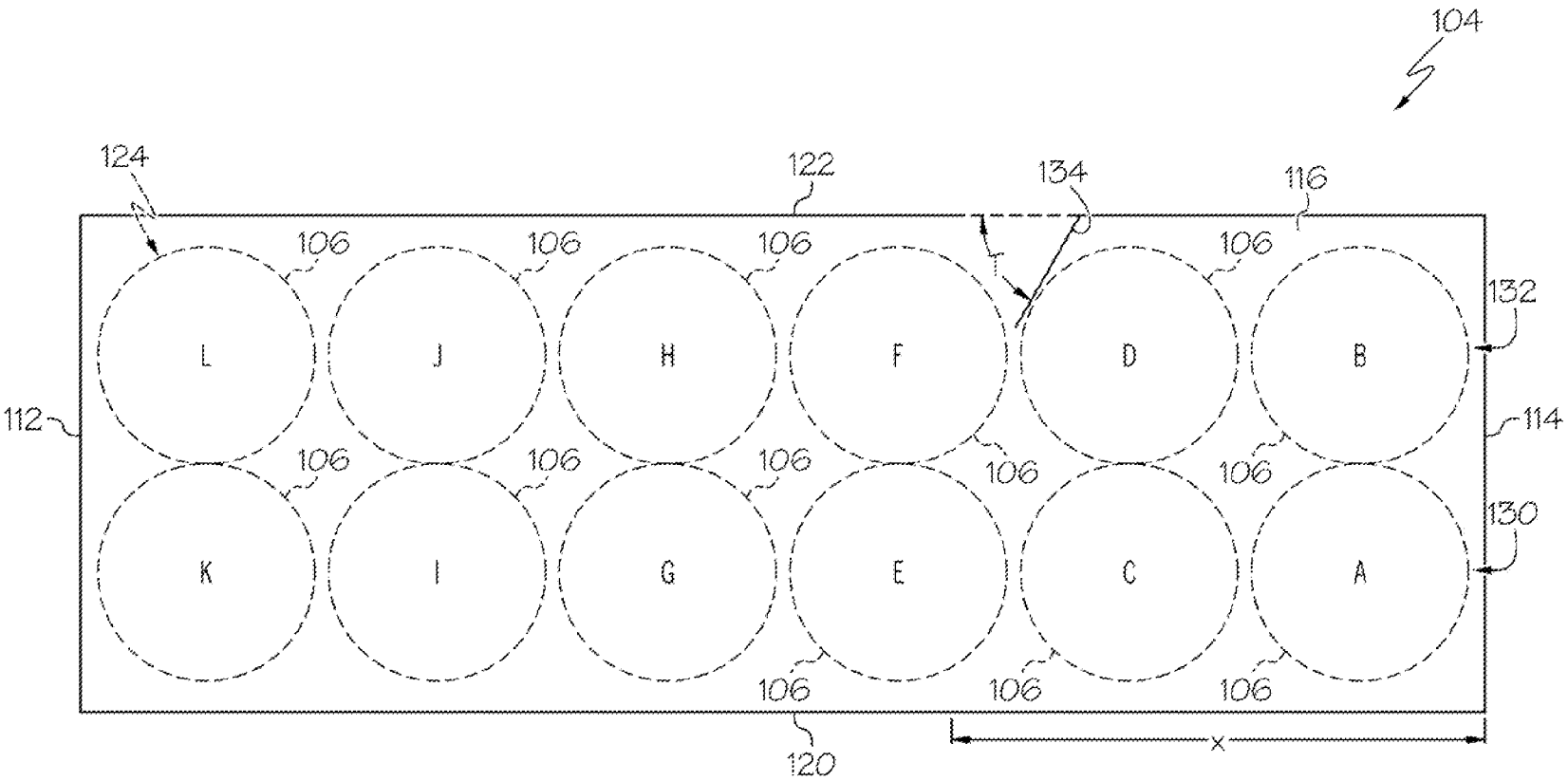
FIG. 3 is a side elevational view of the container of the product dispensing system of FIG. 2.

Referring to FIG. 2, one embodiment of the disclosed product dispensing system with container-product interaction, generally designated 100, may include a dispenser 102 and a container 104. The container 104 may initially house multiple units of product 106, as shown in FIG. 3. When the container 104 is loaded onto the dispenser 102, the container 104 may release the products 106 from the container 104 to the dispenser 102, as shown in FIG. 2.

The container 104 may be any container capable of initially housing products 106 and beneficially interacting with the disclosed dispenser 102 to release the products 106 to the dispenser 102. For example, the container 104 may be a paperboard carton or a corrugated box. Optionally, at least one major surface 108 of the container 104 may be marked with indicia 110, such as printed text and/or graphics.

Figure 4:
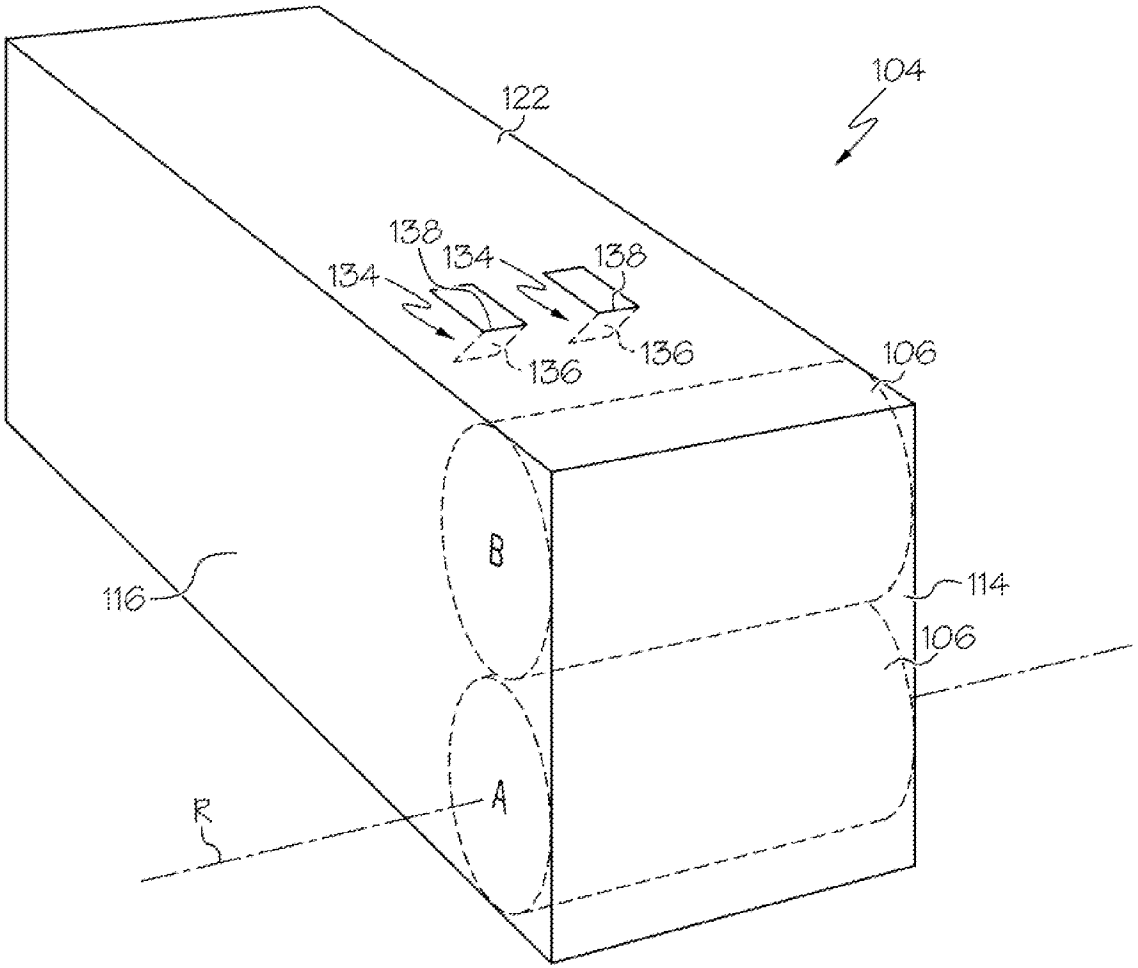
FIG. 4 is a rear and side perspective view of the container of FIG. 3.
Figure 5:
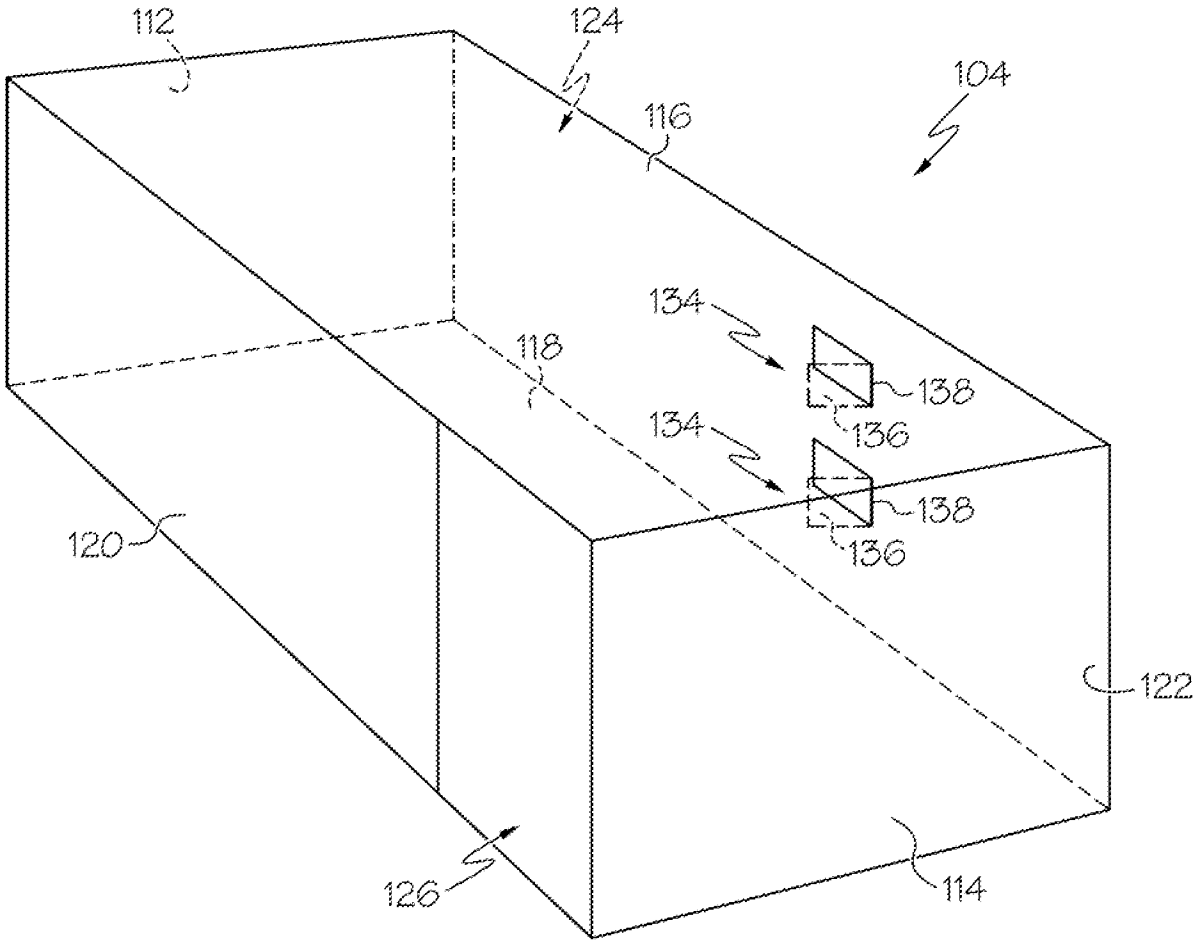
FIG. 5 is a rear and bottom perspective view of the container of FIG. 4.

Referring to FIGS. 3-5, the container 104 may be a generally rectilinear container having six walls 112, 114, 116, 118, 120, 122 that define an internal volume 124 for receiving the products 106. Opposed walls 112 and 114 may define the front and rear walls, respectively, of the container 104. Opposed walls 116 and 118 may define the first (e.g., right) and second (e.g., left) side walls, respectively, of the container 104. Opposed walls 120 and 122 may define the base and upper walls, respectively, of the container 104. Containers of other shapes and configurations are also contemplated.

The base wall 120 of the container 104 may define an access opening 126, as shown in FIG. 5. The access opening 126 may be sized and shaped to allow the products 106 (FIGS. 3 and 4) initially housed in the container 104 to pass therethrough when the container 104 is mounted on the dispenser 102, as shown in FIG. 2.

The access opening 126 may be positioned proximate (i.e., at or near) the rear wall 114 of the container 104, and may extend generally laterally between the side walls 116, 118 of the container 104. However, those skilled in the art will appreciate that the location of the access opening 126 in the container 104 may depend on, among other things, the configuration of the dispenser 102.

Various techniques, including manual and automatic techniques, may be used to form the access opening 126 in the container 104.

In a first construction, the access opening 126 may be pre-formed in the base wall 120 of the container 104. Optionally, a peelable label or the like (not shown) may be applied to the container 104 over the pre-formed access opening 126. Therefore, the access opening 126 may be revealed by peeling away the optional peelable label from the container 104 prior to loading the container 104 onto the dispenser 102.

In a second construction, the access opening 126 may be defined by pre-formed weakening features, such as perforations or zipper strips, in the base wall 120 of the container 104. Therefore, the access opening 126 may be formed by tearing a portion (e.g., a generally rectangular panel) of the base wall 120 away from the container 104 along the pre-formed weakening features prior to loading the container 104 onto the dispenser 102.

In a third construction, the access opening 126 may be automatically formed in the container 104 as the container 104 is urged along the dispenser 102. In a first expression of the third construction, an opening tool associated with the dispenser 102 may form the access opening 126 as the container 104 is urged along the dispenser 102, as described in U.S. Pat. No. 7,922,437 to Loftin et al., the entire contents of which are incorporated herein by reference. In a second expression of the third construction, a catch element associated with the dispenser 102 may form the access opening 126 as the container 104 is urged along the dispenser 102, as described in U.S. patent application Ser. No. 13/032,734 filed by Gelardi et al., the entire contents of which are incorporated herein by reference.

The products 106 may be any products capable of moving from the container 104 to the dispenser 102 and, ultimately, being dispensed by the dispenser 102. In one implementation, the products 106 may be any products capable of rolling about a rolling axis R (FIG. 4). In another implementation, the products 106 may have a generally cylindrical shape, such as a short cylindrical shape or a tall cylindrical shape, and may be capable of rolling about the rolling axis R. For example, the products 106 may be cans (e.g., canned food), jars (e.g., jarred sauce) or bottles (e.g., bottled soft drinks)

Referring to FIG. 3, the products 106 may be initially arranged in rows that longitudinally extend between the front and rear walls 112, 114 of the container 104. Therefore, the rolling axis R (FIG. 4) of each product 106 may be generally normal to the planes defined by the side walls 116, 118 of the container 104.

As an example, products 106A, 106C, 106E, 106G, 1061, 106K may form a first longitudinal row 130 of products 106 and products 106B, 106D, 106F, 106H, 106J, 106L may form a second longitudinal row 132 of products 106. The second row 132 of products 106 may be stacked on top of the first row 130 of products 106 (i.e., the first row 130 of products 106 may be positioned adjacent to the base wall 120 of the container 104 and the second row 132 of products 106 may be positioned adjacent to the upper wall 122 of the container 104). Additional longitudinal rows (not shown) may be positioned between the first row 130 and the second row 132 without departing from the scope of the present disclosure.

Each longitudinal row 130, 132 of products 106 is shown in the drawings as being one product deep (i.e., only one product 106 is positioned between the laterally opposed side walls 116, 118). However, longitudinal rows that are two or more products deep in the lateral direction are also contemplated. Optional divider panels (not shown) may separate laterally adjacent products 106.

Still referring to FIG. 3, an interference member 134 may extend into the internal volume 124 of the container 104 to engage one or more products 106 in the second row 132 of products 106. For example, the interference member 134 may extend into the internal volume 124 to engage product 106F in the second row 132 of products 106. Therefore, engagement between the interference member 134 and products 106 within the second row 132 (e.g., product 106F) may restrict movement toward the rear wall 114 of the container 104 of at least some of the products 106 in the second row 132 when the container 104 is loaded onto the dispenser 102.

The interference member 134 may be substantially rigid or, alternatively, may be flexible and/or deformable. Furthermore, the interference member 134 may be fixedly connected to the container 104 or, alternatively, may be capable of moving, at least slightly, relative to the container 104.

The interference member 134 may extend into the internal volume 124 of the container 104 from the upper wall 122 of the container 104. Therefore, the interference member 134 may protrude generally downward from the upper wall 122 of the container 104 (i.e., toward the base wall 120).

The interference member 134 may extend at a non-zero angle T relative to the plane defined by the upper wall 122 of the container 104. For example, the angle T may be an acute angle, such as about 45 degrees, such that the interference member 134 protrudes toward the front wall 112 (away from the rear wall 114) of the container 104. However, those skilled in the art will appreciate that various configurations of the interference member 134 will be sufficient to restrict movement of at least some of the products 106 in the second row 132 toward the rear wall 114 of the container 104.

The interference member 134 may be spaced a longitudinal distance X from the rear wall 114 of the container 104. The longitudinal distance X may be selected such that the interference member 134 is positioned to align with the product 106 in the second row 132 intended to be engaged by the interference member 134 when the container 104 is loaded onto the dispenser 102. For example, in the configuration shown in FIG. 3, the interference member 134 is generally aligned with product 106F (i.e., the third product from the rear wall 114 in the second row 132). Therefore, the longitudinal distance X may be about two times the greatest diameter of the products 106.

In one realization, the interference member 134 may be integral with the container 104. For example, the interference member 134 may be formed as a flap in the upper wall 122 of the container 104. Specifically, as shown in FIGS. 4 and 5, the interference member 134 (two interference members 134 are shown in FIGS. 4 and 5) may include a flap member 136 partially separated from the upper wall 122 of the container 104 and hingedly connected to the upper wall 122, such as along a pre-formed fold line 138.

Figure 6:
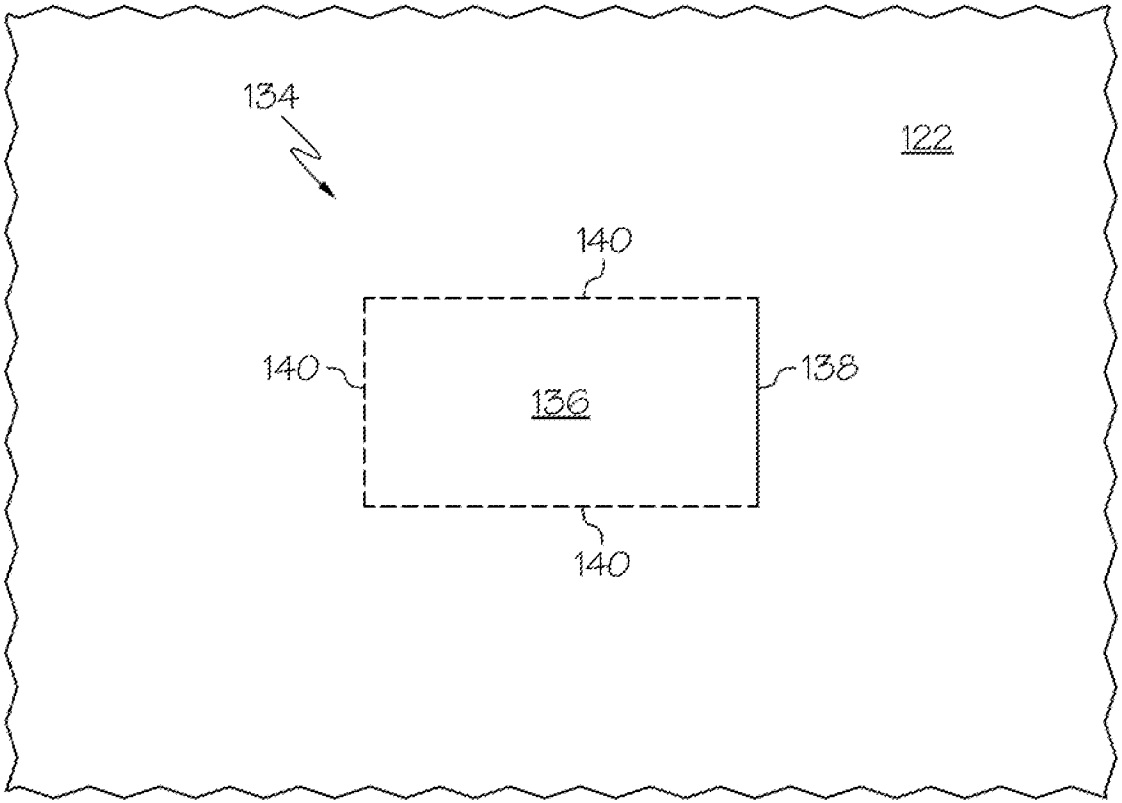
FIG. 6 is a top plan view of a portion of the container of FIG. 5, shown prior to forming the interference member.

Referring to FIG. 6, optionally, the flap member 136 of the interference member 134 may be initially defined by the pre-formed fold line 138 and pre-formed lines of weakness 140 (e.g., perforations) in the upper wall 122 of the container 104. Therefore, the interference member 134 may be formed by separating the flap member 136 from the upper wall 122 by tearing (e.g., piercing) the pre-formed lines of weakness 140 and urging the flap member 136 into the internal volume 124 of the container 104. Therefore, the interference member 134 may be formed only when desired, such as just prior to loading the container 104 onto the dispenser 102.

In another realization, the interference member 134 may be formed as a separate piece, and may be connected to the container 104, such as the upper wall 122 of the container 104, by an adhesive, a mechanical fastener or the like. Therefore, various structures may be used to form the interference member 134.

Alternatively, the interference member 134 may extend into the internal volume 124 of the container 104 from one (or both) of the side walls 116, 118 of the container 104. Therefore, the interference member 134 may protrude generally laterally inward to restrict movement toward the rear wall 114 of at least some of the products 106 in the second row 132 of the container 104 when the container 104 is loaded onto the dispenser 102.

Figure 7:
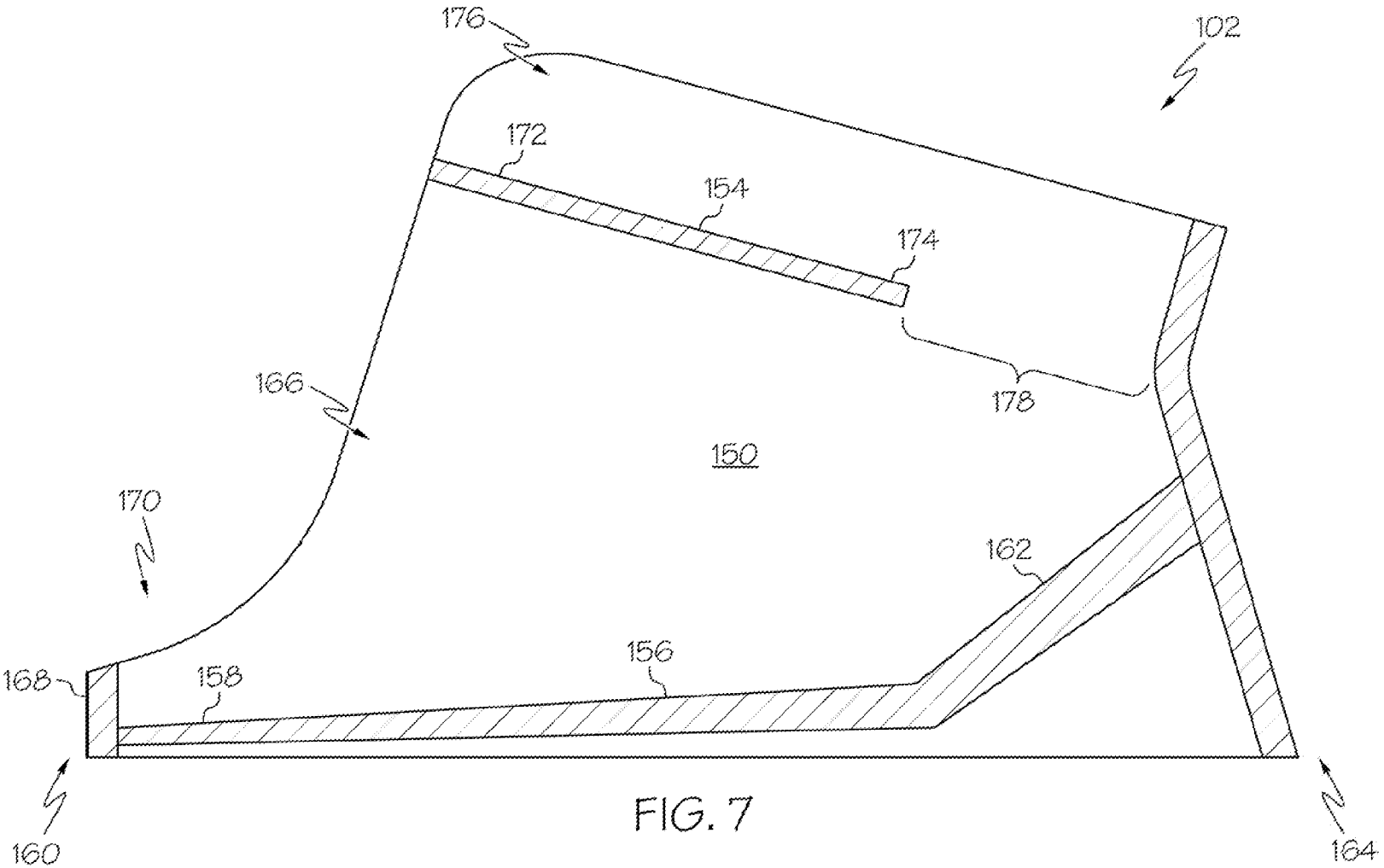
FIG. 7 is a side elevational view, in section, of the dispenser of the product dispensing system of FIG. 2.

Referring to FIG. 7, the dispenser 102 may include a first (e.g., left) side wall 150, a second (e.g., right) side wall 152 (FIG. 2), a container support deck 154 and a lower support deck 156. The left side wall 150 may be laterally spaced from the right side wall 152, and may be generally parallel with the right side wall 152.

The lower support deck 156 may laterally extend between the left and right side walls 150, 152, and may include a front end 158 that longitudinally extends toward the front end 160 of the dispenser 102 and a rear end 162 that longitudinally extends toward the rear end 164 of the dispenser 102. Therefore, the lower support deck 156 and the side walls 150, 152 may define a lower level 166 of the dispenser 102.

The lower support deck 156 may be inclined from the front end 158 to the rear end 162 (i.e., the rear end 162 may be elevated relative to the front end 158) such that products 106 deposited proximate the rear end 162 of the lower support deck 156 roll down to the front end 158 of the lower support deck 156 under the force of gravity.

A stop 168 may be positioned proximate the front end 158 of the lower support deck 156 to prevent products 106 from rolling beyond the front end 158 of the lower support deck 156. Therefore, the stop 168 may collect products 106 at the front end 158 of the lower support deck 156, thereby defining a product display area 170 proximate the front end 158 of the lower support deck 156.

The container support deck 154 may laterally extend between the left and right side walls 150, 152, and may include a front end 172 that longitudinally extends toward the front end 160 of the dispenser 102 and a rear end 174 that longitudinally extends toward, but not to, the rear end 164 of the dispenser 102. Therefore, the container support deck 154 and the side walls 150, 152 may define an upper level 176 of the dispenser 102.

The spacing between the rear end 174 of the container support deck 154 and the rear end 164 of the dispenser 102 may define a dispenser opening 178, which may function as a chute to allow products 106 to move from the upper level 176 to the lower level 166 of the dispenser 102 under the force of gravity. The access opening 126 (FIG. 5) in the container 104 may be aligned with the dispenser opening 178 of the dispenser 102 when the container 104 is fully loaded onto the dispenser 102.

The container support deck 154 may be declined from the front end 172 to the rear end 174 (i.e., the front end 172 may be elevated relative to the rear end 174). Therefore, the force of gravity may urge products 106 supported on the container support deck 154 toward the rear end 174 of the container support deck 154 and, ultimately, toward the dispenser opening 178.

Figure 8:
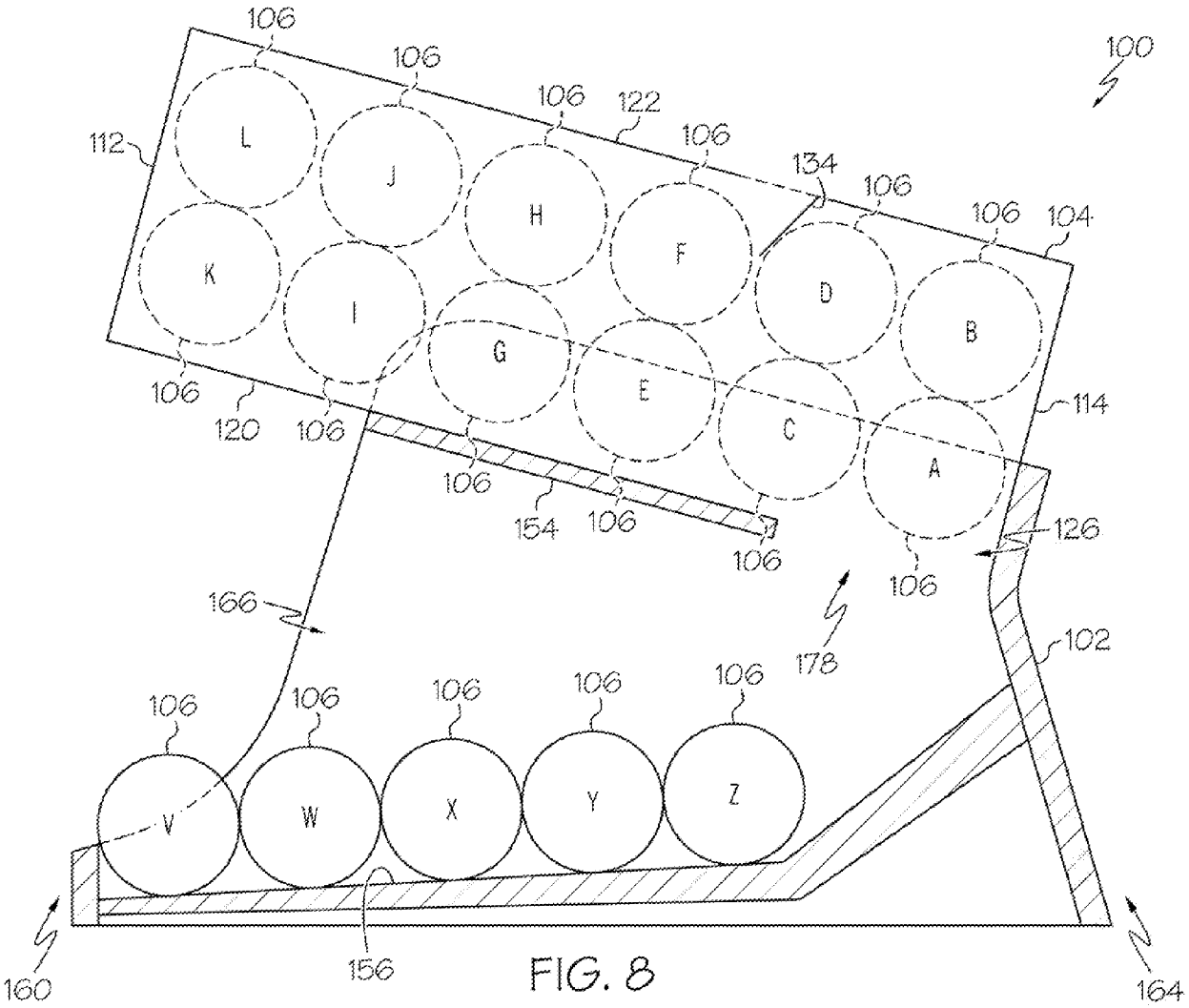
FIG. 8 is a side elevational view, in section, of the product dispensing system of FIG. 2, shown during one phase of dispensing.
Figure 9:
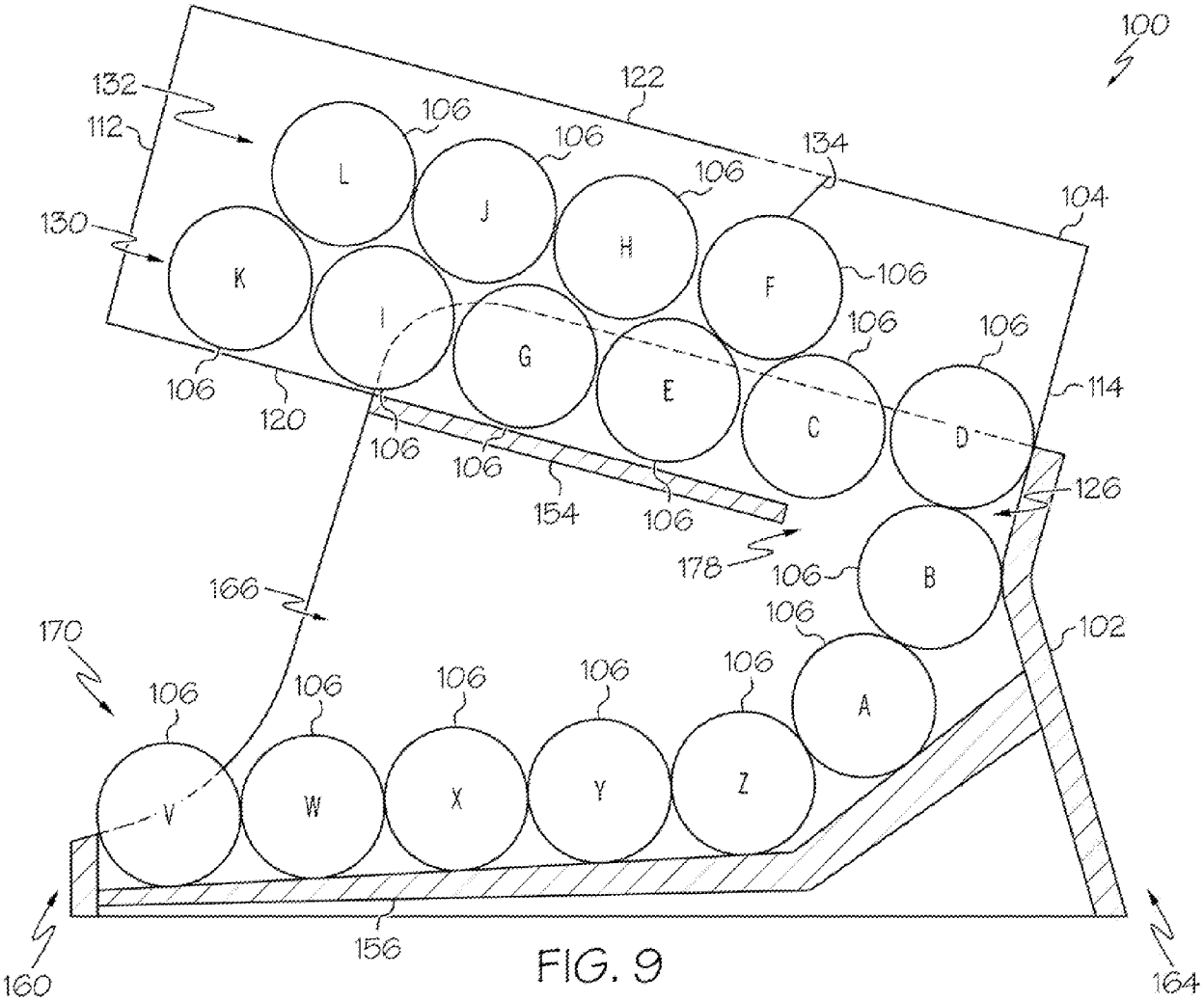
FIG. 9 is a side elevational view, in section, of the product dispensing system of FIG. 8, shown during another phase of dispensing.

Referring to FIGS. 8 and 9, the product dispensing system 100 may be assembled by positioning the container 104 onto the container support deck 154 of the dispenser 102 such that the access opening 126 of the container 104 is aligned with the dispenser opening 178 of the dispenser 102, as shown in FIG. 8. For example, the container 104 may be longitudinally urged along the container support deck 154 toward the rear end 164 of the dispenser 102 until the access opening 126 is aligned with the dispenser opening 178. Optionally, as noted above, the access opening 126 may be formed during the step of longitudinally urging the container 104 along the container support deck 154 of the dispenser 102.

If necessary, the interference member 134 of the container 104 may be deployed prior to loading the container 104 onto the dispenser 102. For example, when the interference member 134 includes a flap member 136 defined by pre-formed lines of weakness 140 (e.g., perforations), as shown in FIG. 6 and discussed above, the step of deploying the interference member 134 may include separating the flap member 136 from the upper wall 122 of the container 104 by tearing (e.g., piercing) the pre-formed lines of weakness 140 and urging the flap member 136 into the internal volume 124 of the container 104.

When the access opening 126 of the container 104 is aligned with the dispenser opening 178 of the dispenser 102, product 106A and product 106B may exit the container 104 through the access opening 126 and may pass through the dispenser opening 178 down to the lower level 166 of the dispenser 102, as shown in FIG. 9. Product 106D may drop from the second row 132, and may be positioned to the rear of product 106C and below the centerline (rolling axis R in FIG. 4) of product 106C such that product 106D may be capable of exiting the container 104 through the access opening 126 without bridging. The presence of products 106V-106Z from a previous container (not shown) may partially fill the lower level 166 such that product 106D will not completely pass through the access opening 126 until product 106V is removed from the product display area 170.

Product 106F in the second row 132 of products 106 may move toward the rear end 164 of the dispenser 102 until product 106F is engaged by the interference member 134, which may interfere with (i.e., prevent or at least inhibit) further rearward movement of product 106F in the second row 132. Therefore, with product 106F engaged by the interference member 134, product 106F may be significantly less likely to move to a bridging configuration wherein product 106F becomes wedged between product 106C (above the centerline of product 106C) and the rear wall 114 of the container 104.

With the interference member 134 inhibiting products 106 in the second row 132 from moving to a bridging configuration, the remaining products 106 within the container 104 may exit the container 104 through the access opening 126 as products 106 are removed from the dispenser 102 by way of the product display area 170.

Accordingly, the disclosed product dispensing system 100 may reduce or eliminate the occurrence of product bridging within the container 104 by configuring the container 104 to include an interference member 134 that interferes with products 106 in the second row 132 as the products 106 in the second row 132 move toward the rear wall 114 of the container 104 under the force of gravity.

Although various embodiments of the disclosed product dispensing system with container-product interaction have been shown and described, modifications may occur to those skilled in the art upon reading the specification. The present application includes such modifications and is limited only by the scope of the claims.

What is claimed is

1. A product dispensing system comprising:

a dispenser having a front end longitudinally opposed from a rear end, said dispenser comprising a container support deck extending at least partially between said front end and said rear end and a lower support deck positioned below said container support deck, said lower support deck defining a product display area;

a container positioned on said container support deck, said container defining an internal volume and an access opening into said internal volume, said container comprising an interference member extending into said internal volume, wherein said interference member is vertically opposed from said access opening; and a plurality of products received in said internal volume and arranged in at least a first longitudinal row and a second longitudinal row, said second longitudinal row being positioned above and in contact with said first longitudinal row, wherein said interference member extends into the second longitudinal row and is positioned to contact at least one product of said plurality of products and restrict longitudinal movement of said at least one product, said at least one product being in said second longitudinal row.

2. The product dispensing system of claim 1 wherein said lower support deck extends at least partially between said front end and said rear end.

3. The product dispensing system of claim 1 wherein said product display area is proximate said front end.

4. The product dispensing system of claim 1 wherein said container comprises:

a front wall longitudinally opposed from a rear wall;

a first side wall laterally opposed from a second side wall; and a base wall vertically opposed from an upper wall.

5. The product dispensing system of claim 4 wherein said interference member is connected to said upper wall.

6. The product dispensing system of claim 5 wherein said interference member protrudes toward said front wall.

7. The product dispensing system of claim 4 wherein said interference member is integral with said upper wall.

8. The product dispensing system of claim 4 wherein said interference member is hingedly connected to said upper wall.

9. The product dispensing system of claim 4 wherein said interference member is positioned to restrict longitudinal movement of said at least one product toward said rear wall.

10. The product dispensing system of claim 4 wherein said access opening is proximate said rear wall.

11. The product dispensing system of claim 10 wherein said interference member is positioned between said front wall and said access opening.

12. The product dispensing system of claim 10 wherein said plurality of products are sized and shaped to pass through said access opening and move to said product display area under a force of gravity.

13. The product dispensing system of claim 4 wherein said first longitudinal row is positioned adjacent to said base wall and said second longitudinal row is positioned adjacent to said upper wall.

14. The product dispensing system of claim 4 wherein said second longitudinal row comprises a first product of said plurality of products and a second product of said plurality of products, said first product being positioned between said second product and said rear wall.

15. The product dispensing system of claim 14 wherein said interference member is positioned to restrict longitudinal movement of said second product toward said rear wall.

16. The product dispensing system of claim 1 wherein each product of said plurality of products is configured to roll about a rolling axis.

17. A product dispensing system comprising:

a dispenser having a front end longitudinally opposed from a rear end, said dispenser comprising:

a container support deck extending at least partially between said front end and said rear end, said container support deck defining a dispenser opening; and a lower support deck positioned below said container support deck, said lower support deck defining a product display area;

a container positioned on said container support deck, said container comprising a front wall longitudinally opposed from a rear wall, a first side wall laterally opposed from a second side wall, and a base wall vertically opposed from an upper wall, said container defining an internal volume, and said base wall defining an access opening into said internal volume, wherein said access opening is aligned with said dispenser opening, said container comprising an interference member that extends into said internal volume, wherein said interference member is connected to said upper wall between said front wall and said rear wall;

a plurality of products received in said internal volume, said plurality of products being arranged into at least a first longitudinal row and a second longitudinal row, said second longitudinal row being positioned above and in contact with said first longitudinal row, wherein said interference member extends into said second longitudinal row.

18. A method for dispensing products comprising the steps of:

providing a dispenser comprising:

a container support deck; and a lower support deck positioned below said container support deck, said lower support deck defining a product display area;

providing a container initially housing a plurality of products, wherein said plurality of products are arranged in at least a first longitudinal row and a second longitudinal row, said second longitudinal row being positioned above and in contact with said first longitudinal row, said container comprising an interference member extends into the second longitudinal row within extending into said internal volume;

forming an access opening in said container, said access opening being size to allow said plurality of products to pass therethrough, said access opening being vertically below said interference member;

positioning said container with said access opening on said container support deck such that at least one product of said plurality of products exits said container through said access opening and moves to said product display area; and while said container is positioned on said container support deck, restricting longitudinal movement toward said access opening of said products of said plurality of products in said second longitudinal row.

19. The method of claim 18, wherein said restricting step comprises engaging said products in said second longitudinal row with said interference member.

20. The method of claim 19, wherein said interference member is connected to said container.

* * * * *